US005951275A

United States Patent [19]

Takahashi

[11] Patent Number: 5,951,275

[45] Date of Patent: Sep. 14, 1999

[54] METHOD FOR REMOVING OILY SUBSTANCES FROM METALLIC ARTICLES

[75] Inventor: Susumu Takahashi, Yokohama, Japan

[73] Assignee: Kanto Yakin Kogyo K.K., Japan

[21] Appl. No.: 09/100,358

[22] Filed: Jun. 19, 1998

[30] Foreign Application Priority Data

Nov. 28, 1997 [JP] Japan ..... 9-364246

[51] Int. Cl.[6] ..... F23B 7/00

[52] U.S. Cl. ..... 431/5; 126/91 A; 110/236; 29/403.3; 29/403.4; 134/21

[58] Field of Search ..... 431/5, 215; 126/91 A; 110/238, 236, 256; 29/403.4, 403.3; 134/19, 21

[56] References Cited

U.S. PATENT DOCUMENTS

| | | | |
|---|---|---|---|
| 3,346,417 | 10/1967 | Ehrlich | 134/2 |
| 3,564,699 | 2/1971 | Moore | 29/403 |
| 3,598,649 | 8/1971 | Juhasz | 134/2 |
| 3,734,774 | 5/1973 | Culpepper, Jr. | 134/2 |
| 3,745,942 | 7/1973 | Thompson et al. | 110/8 R |
| 3,821,026 | 6/1974 | Swartz | 134/2 |
| 4,915,038 | 4/1990 | Sujata et al. | 110/346 |
| 4,988,287 | 1/1991 | Stegelman et al. | 431/284 |
| 5,724,901 | 3/1998 | Guy et al. | 110/346 |

*Primary Examiner*—Ira S. Lazarus
*Assistant Examiner*—Donna Mann
*Attorney, Agent, or Firm*—Shelsinger, Fitzsimmons & Shlesinger

[57] ABSTRACT

Combustibles such as oily substances adhered to or impregnated in metallic articles are removed, before the articles are subjected to a heat-treatment for carburizing or sintering them, by heating them in a heating chamber with a combustion tube, and discharging the combustibles outside of the chamber after having sucked under a negative air pressure the combustibles into the tube instantly they have been evaporated from the articles and after having burnt the combustibles in the tube.

4 Claims, 1 Drawing Sheet

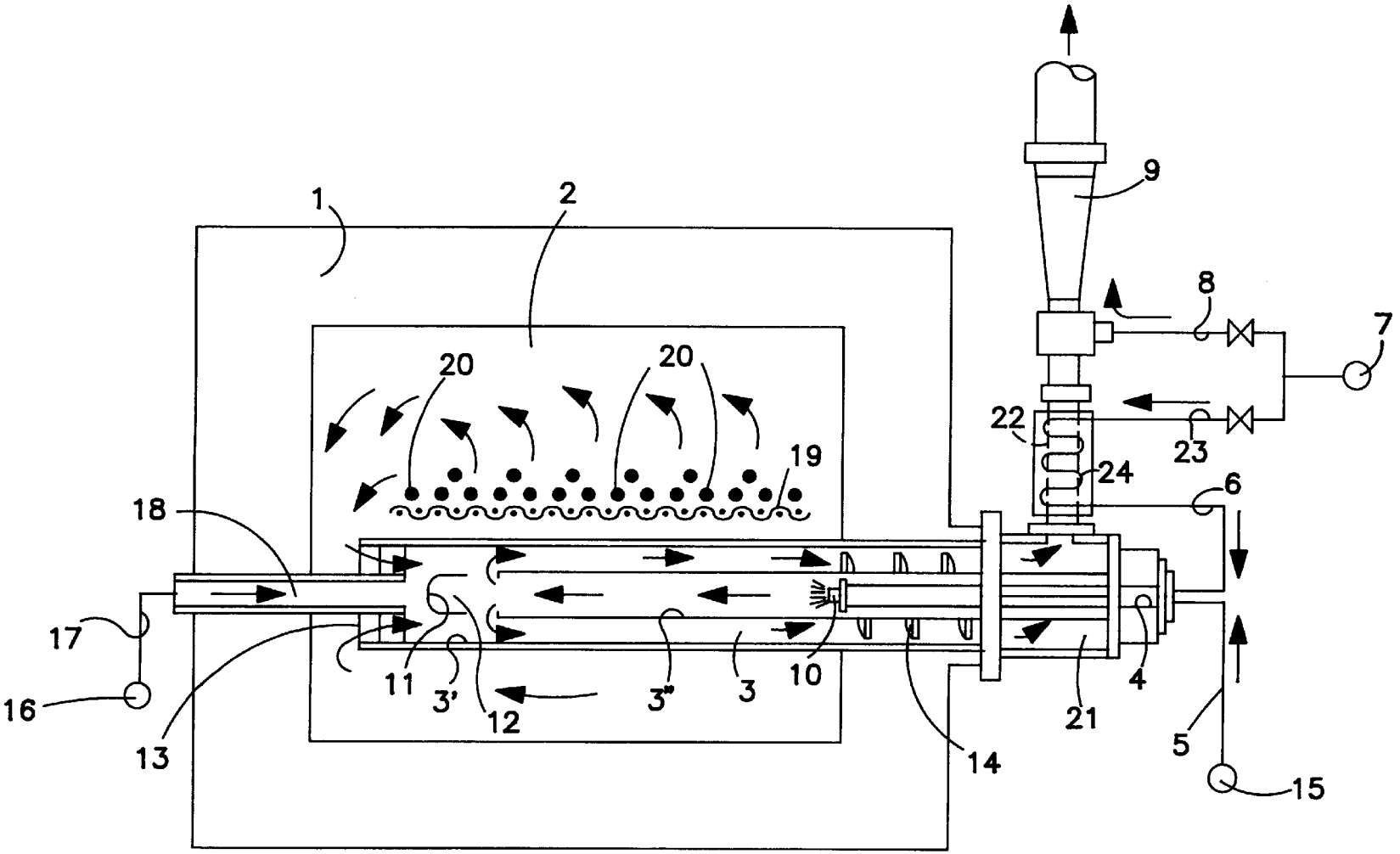
FIG. I

METHOD FOR REMOVING OILY SUBSTANCES FROM METALLIC ARTICLES

BACKGROUND OF THE INVENTION

Metallic articles to be heat-treated are most commonly adhered or impregnated with machine oils or powder metallurgical waxes which are unnecessary and obstructive for heat-treatments for their carburization, sintering and so on. Such oils and waxes must be removed before the articles are subjected to the heat-treatments.

This invention relates to a method for removing from articles to be heat-treated, before they are heat-treated, combustibles such as above-mentioned unnecessary and obstructive oily substances, and also to an apparatus therefor.

There is described in Japanese Preliminary Patent Publication No.Hei-9-170091 a method of removal by evaporation of oily substances from metallic articles, in which the articles are heated in a heating chamber for evaporating the oily substances adhered to the articles, evaporated oily substances are led with a heating atmosphere to the outside of the chamber, they are separated at the outside to the oily substances and the heating atmosphere, and the substances and atmosphere thus separated are resent to the heating chamber where the oily substances are utilized as a heating source of burners in the chamber, and the atmosphere is reused as a heating atmosphere of the chamber.

Although this prior method contributes to the saving of fuel and so on, and is also favorable in an environmental protection, since it does not employ harmful organic solvents such as trichloroethylene, the method and an apparatus for achieving it are not so simple.

It is therefore, an object of this invention to provide a method for removing from articles to be heat-treated, before they are subjected to a heat-treatment, oily combustibles which are unnecessary and obstructive to the heat-treatment, without employing harmful organic solvents on account of an environmental protection and in a simple manner than the method taught by the above-mentioned Japanese Preliminary Patent Publication.

SUMMARY OF THE INVENTION

While the method and apparatus of this invention is same to those of the aforementioned Japanese Preliminary Patent Publication with respect to that articles to be heat-treated are heated by burners which are set in a heating chamber and burn a combustion gas supplied from the outside of the chamber, it is characterized in this invention that oily combustibles evaporated or sublimed from the articles and freed in the heating chamber are not led to the outside of the chamber, but are discharged to the outside of the chamber only after they have been sucked into the burners and burnt therein instantly they were freed in the chamber.

Accordingly, in this invention, oily combustibles removed from articles to be heat-treated are utilized as one of heating sources for burners directly without any pretreatment of them in complicated steps, and are discharged to the air as a harmless gas.

THE DRAWINGS

FIG. 1 is an explanatory cross-sectional view of a heating apparatus which can be employed advantageously for performing the method of this invention.

DETAILED DESCRIPTION OF THE PREFERRED EMBODIMENTS

An apparatus which can preferably be employed in this invention, is explained first with reference to FIG. 1.

In a heating chamber 2 of a rectangular cross section and having a thermally insulated outer shell 1, articles to be heat-treated 20 are heated. These articles are charged into the chamber 2 and discharged out therefrom, being carried on a moving support 19 such as a mesh belt conveyor.

A cylindrical burner 3 for heating the articles 20 in the chamber 2 is fitted at parts thereof to the outer shell 1, and is comprised of an outer tube 3' and an inner tube 3". A free end 13 of the outer tube 3' which is located within the heating chamber 2, opens to the chamber. The inner tube 3" which is within the outer tube 3' and extends coaxially therewith, communicates with the outer tube 3' adjacently to its inner end 11 through its openings 12.

Within the inner tube 3" and adjacently to an end opposite to the inner end 11, there is provided a nozzle 10 for burning a combustion gas. A pipe 4 for sending the combustion gas to the nozzle 10 is connected to a pipe 5 which is in turn connected to a combustion gas source 15, and also connected to another pipe 6 which is in turn connected to an air source 7.

A pipe 18 which is fitted at one end to the outer shell 1 and connected at its opposite end to another air source 16 through a pipe 17, opens in the free end 13 of the outer tube 3' which in turn opens to the heating chamber 2. Numeral 14 indicates heat exchange fins fitted to outer surfaces of the inner tube 3".

An exhaust pipe 9, the outer end of which opens to the air, communicates at its inner end with the outer tube 3'.

The above-mentioned air supplying pipe 6 is connected to the air source 7 through a pipe 23 and another pipe 24 which is helically mounted on a pipe 22 of the exhaust pipe 9. A pipe 8 which is connected at its one end to the air source 7 and connected at its other end to the exhaust pipe 9, works to give a negative air pressure to the exhaust pipe 9.

Numeral 21 indicates a zone of the outer tube 3' which preheats a mixture of a combustion gas and air sent to the pipe 4 before the mixture is burnt at the nozzle 10.

The apparatus having the above-mentioned structures operates as follows.

The air sent from the air source 7 to the nozzle 10 is heated by an exhaust gas passing through the pipe 22, when it passes through the helical pipe 24. A combustion gas mixed with the air thus heated is additionally heated at the preheating zone 21 of the outer tube 3', whereby the gas burns completely at the nozzle 10.

To the exhaust pipe 9, there is applied, as explained above, a negative air pressure which is caused by the air sent from the air source 7 through the pipe 8 to the exhaust pipe 9 at a pressure of 1,000 Aq for example. On account of this negative air pressure, the combustion gas burnt at the nozzle 10 and within the inner tube 3" is drawn into the outer tube 3' through the openings 12, as indicated by arrows in the drawings, sucked towards the exhaust pipe 9, and finally discharged from the exhaust pipe 9 to the air.

Oily combustibles which have been heated and evaporated from the articles 20, are also drawn into the outer tube 3' through its free end 13, as indicated by arrows in the drawings, burnt in the outer tube, and discharged from the exhaust pipe 9 to the air.

When additional air is required for completely burning the oily combustibles in the outer tube 3', it may be supplied from the pipe 17 into the outer tube.

EXAMPLE 1

Metallic articles, that is, tap screws of JIS B1115 (made from iron steel of JIS SWCH12K and having a nominal diameter of 6mm and nominal length of 50 mm) were heated in accordance with this invention, before they were subjected to a heat-treatment for carburization (of a heating temperature of 930° C.). The screws were adhered with 100 cc of a machine oil (having a flash point of 80° C. and a kinematic viscosity of 2.88 cSt to 3.52 cSt) per 10 Kg of the screws.

The apparatus of the above-mentioned structures (having a heating chamber 2 of an effective heating dimensions of 80 cm in width, 18 cm in height, and 180 cm in length) was employed for heating them. Its heating atmosphere was the air.

A town gas of 10 Kcal mixed with the air at a mixing ratio of 1:11 was burnt at the nozzle 10, and the heating chamber 2 was kept at 500° C.

The screws 20 mounted on the conveyor belt 19 were passed through the chamber in 25 minutes. This means that 250 Kg of the screws were heated in an hour, and the machine oil adhered to the screw was removed at 250 cc per an hour.

It was confirmed by measuring the weights the screws had before heating and after heating and also by observing soots accompanied to the heating that all of the amounts of machine oil adhered to the screws had been evaporated and burnt. And, in the gas discharged from the exhaust pipe 9, there was not found any machine oil which had not been decomposed.

The heat of 2,200 Kcal was produced per an hour by the burning in the outer tube 3' of the machine oil of 250 cc which had been removed from the screws 20. This means that about 10% of the combustion gas employed in heating has been saved.

It shall be noted that when the screws were forwarded into a carburizing furnace instantly they were carried out from the heating chamber 2, it was not necessary to preheat them again because they had been heated to 500° C. in the chamber 2.

EXAMPLE 2

Driven gears for motor cycles (of an outer diameter of 15 cm and thickness of 1 cm) molded by Fe-Cu-C alloy powders with a powder metallurgical lubricant wax (of a melting point of 140–145° C., a flash point of 285° C., and a specific gravity of about 0.97) were heated in accordance with this invention before they were subjected to a heat-treatment for sintering (of a heating temperature of 1,140° C.).

Each of the gears weighed 450 g, and the wax impregnated thereto was 0.75 weight % of the gears.

In this Example, the effective heating dimensions of the chamber 2 was made 80 cm in width, 10 cm in height, and 180 cm in length. The chamber was heated same to Example 1, and kept at 650° C. However, because of that nitrogen which was sent by an atmosphere supplying pipe (not shown) into the chamber, was employed as a heating atmosphere in this Example, an air was supplied from the tube 18 into the outer tube 3' occasionally as needed in order to ensure the complete combustion of the wax sublimed from the gears.

The gear compacts 20 were passed through the heating chamber 2 in 20 minutes. This means that 135 pieces of compacts were treated in accordance with this invention in an hour, and 455 g of the lubricant wax was sublimed and removed from the compacts in an hour.

It was confirmed by measuring weights the gear compacts had before and after heating that all of the amounts of wax contained in them had been removed. The gas exhausted from the exhaust pipe 9 contained a carbonic acid gas, water, and nitrogen only, but no harmful gas.

The gear compacts were sent into a sintering furnace as they were without preheating them, since they had been heated to 650° C.

As described above in detail, those oily combustibles which adhere or are impregnated to metallic articles to be heat-treated and which are unnecessary and obstructive for a heat-treatment, can readily and economically be removed from the articles in accordance with this invention.

It is really advantageous to various industries that by this invention, combustibles evaporated or sublimed from metallic articles to be heat-treated are not discharged outside as they are, but they are burnt in a combustion tube within a heating chamber as they have been heated in the chamber, resulting in not losing heat energies, making their burning easy and complete, and making an exhaust gas harmless. It is also noticeable that since the articles are carried out from the chamber, having been heated, they can be sent to a succeeding carburizing or sintering heat-treatment as they are without preheating them again in advance.

I claim:

1. A method, in advance of a heat-treatment such as for carburizing or sintering metallic articles, for removing from the articles to be subjected to the heat-treatment those combustibles such as oily substances which are unnecessary or obstructive for such heat-treatment, which comprises heating the articles within a heating chamber by a combustion tube installed within said heating chamber for burning a combustion gas sent to the combustion tube from the outside of the heating chamber, creating a negative air pressure in the combustion tube via an exhaust pipe connected thereto, sucking into the combustion tube via said negative air pressure the combustibles evaporated or sublimed from the heated articles and freed into the heating chamber, burning the combustibles in the combustion tube, and discharging out of the exhaust pipe the combustibles which have been burnt in the combustion tube.

2. The method as claimed in claim 1, including conveying said articles through said heating chamber and adjacent to said combustion tube to be heated thereby in said heating chamber.

3. An apparatus for removing in advance of a heat-treatment those combustible adhered to or impregnated in metallic articles that are to be subjected to the heat-treatment in a heating chamber, comprising a combustion tube installed within said heating chamber for burning a combustion gas applied to said combustion tube from the outside of the heating chamber and for effecting the heating of the articles within said heating chamber, the combustion tube having one end thereof positioned within and opening upon the interior of said heating chamber, and having an exhaust pipe connected to the opposite end thereof and maintained at a negative pressure.

4. The apparatus as claimed in claim 3, including means connected to said exhaust pipe for maintaining said negative pressure in said pipe, and operative for sucking the combustibles evaporated or sublimed from the heated articles from said heating chamber and into the combustion tube and for discharging to the outside of the chamber the combustibles which have been burnt out in the combustion tube.

* * * * *